US010030324B2

(12) United States Patent
Schneider et al.

(10) Patent No.: US 10,030,324 B2
(45) Date of Patent: Jul. 24, 2018

(54) SPINNING MACHINE COMPACTION APPARATUS WITH SUCTION DRUM

(71) Applicant: Maschinenfabrik Rieter AG, Winterthur (CH)

(72) Inventors: Gabriel Schneider, Winterthur (CH); Robert Nägeli, Kleinandelfingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 17 days.

(21) Appl. No.: 15/121,988

(22) PCT Filed: Feb. 16, 2015

(86) PCT No.: PCT/IB2015/000158

§ 371 (c)(1),
(2) Date: Aug. 26, 2016

(87) PCT Pub. No.: WO2015/128713

PCT Pub. Date: Sep. 3, 2015

(65) Prior Publication Data

US 2017/0073851 A1 Mar. 16, 2017

(30) Foreign Application Priority Data

Feb. 27, 2014 (CH) ..... 284/14

(51) Int. Cl.
*D01H 5/72* (2006.01)

(52) U.S. Cl.
CPC ..... *D01H 5/72* (2013.01)

(58) Field of Classification Search
CPC .. D01H 5/72; D01H 5/66; D01H 5/68; D01H 5/26; D01H 4/06; D01H 4/16; D01H 3/00
(Continued)

(56) References Cited

U.S. PATENT DOCUMENTS 3,055,165 A * 9/1962 Richards ..... A41G 3/0075 57/29
3,665,695 A * 5/1972 Amato ..... D01H 4/28 57/315

(Continued)

FOREIGN PATENT DOCUMENTS

DE 21 51 926 A1 4/1973
DE 33 16 656 A1 11/1984

(Continued)

OTHER PUBLICATIONS

Swiss Patent Office Search Report, dated May 13, 2014.
PCT Search Report, dated Jul. 16, 2015.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

An apparatus for compacting a fiber sliver on a spinning machine, has a carrier which has a receptacle for a bolt. A rotatably mounted suction drum has a closed end face and an open end face. A bearing element is disposed in the region of the closed end face. The suction drum is rotatably mounted on an end section of the bolt by the bearing element so that the bolt protrudes out of the open end face of the suction drum. To permit assembly and/or disassembly of the suction drum during the entire running time of the compaction apparatus, the suction drum is affixed axially by means of the bearing element with the bolt, as seen in its axial direction, so that the suction drum and the bolt form a separate unit of the apparatus. A fastening means by means of which the bolt is releasably fastened in the receptacle is provided.

15 Claims, 5 Drawing Sheets

(58) Field of Classification Search
USPC ..... 19/246; 57/315–316
See application file for complete search history.

(56) References Cited

U.S. PATENT DOCUMENTS

| | | | | | |
|---|---|---|---|---|---|
| 3,972,171 | A * | 8/1976 | Handschuch | D01H 4/08 | 24/279 |
| 4,537,022 | A * | 8/1985 | Stahlecker | D01H 4/16 | 57/401 |
| 4,697,409 | A * | 10/1987 | Handschuch | D01H 4/16 | 57/401 |
| 4,702,068 | A * | 10/1987 | Whiteley | D01H 4/16 | 57/401 |
| 4,858,422 | A * | 8/1989 | Stahlecker | D01H 4/16 | 57/401 |
| 5,477,591 | A | 12/1995 | Morell | | |
| 6,324,825 | B2 * | 12/2001 | Dinkelmann | D01H 1/025 | 19/150 |
| 6,332,244 | B1 * | 12/2001 | Camozzi | D01H 1/22 | 19/150 |
| 6,568,041 | B2 * | 5/2003 | Camozzi | D01H 5/72 | 19/150 |
| 6,668,536 | B2 * | 12/2003 | Wassenhoven | D01H 4/14 | 57/407 |
| 7,472,537 | B2 * | 1/2009 | Brunk | D01H 1/00 | 57/130 |
| 7,942,651 | B2 * | 5/2011 | Bin-Nun | F25B 1/02 | 310/153 |
| 9,127,378 | B2 * | 9/2015 | Schneider | D01H 5/72 | |
| 9,347,151 | B2 * | 5/2016 | Malina | D01H 5/74 | |
| 2013/0239369 | A1 * | 9/2013 | Schneider | D01H 5/72 | 19/246 |
| 2013/0239721 | A1 * | 9/2013 | Schneider | D01H 5/72 | 74/412 R |
| 2014/0157749 | A1 * | 6/2014 | Schneider | D01H 5/72 | 57/315 |
| 2015/0027098 | A1 * | 1/2015 | Nageli | D01H 5/72 | 57/315 |
| 2016/0222553 | A1 * | 8/2016 | Malina | D01H 5/72 | |

FOREIGN PATENT DOCUMENTS

| | | | |
|---|---|---|---|
| DE | 36 12 066 | A1 | 10/1987 |
| DE | 100 17 999 | A1 | 10/2001 |
| DE | 100 19 636 | A1 | 10/2001 |
| WO | WO 2012/068692 | A1 | 5/2012 |
| WO | WO 2012/068693 | A1 | 5/2012 |
| WO | WO 2014/027234 | A2 | 2/2014 |

* cited by examiner

SPINNING MACHINE COMPACTION APPARATUS WITH SUCTION DRUM

FIELD OF THE INVENTION

The invention relates to an apparatus for compacting a fiber composite on a spinning machine, having a carrier, which has a receptacle for a bolt, having a suction drum, which is rotatably mounted and has a closed end side an open end side and a bearing element is disposed in the area of the closed end side. The suction drum is rotatably mounted on an end section of the bolt by means of this bearing element, wherein the bolt protrudes out of the open end side of the suction drum.

BACKGROUND

WO 2012068692 A1 describes an apparatus for compaction of a fiber material on a spinning machine, which is provided for the subsequent addition onto a conventional drawing mill device of a spinning machine. The apparatus is disposed downstream from the drawing mill unit of the spinning machine and serves to compact a fiber material discharged from the drawing mill unit. Following the compaction apparatus, the compacted fiber material, after passing through a pinch point, is sent to a twist-creating device. The twist-creating device consists of a rotor, for example, which revolves on a ring in the case of a ring-spinning machine, for example, wherein the yarn thereby produced is wound onto a rotating sleeve.

For use on the usual twin drawing mills of ring-spinning machines, the compaction apparatus described in WO 2012068692 A1 has two driven and rotating suction drums, which are acted upon by suction air and are rotatably mounted, so that they are axially parallel to one another and spaced a distance apart from one another by means of a bearing element on a shaft mounted on a carrier. The carrier has a receptacle for rotationally fixed mounting of the shaft. To axially secure the suction drums on the shaft, a sleeve-type locking element is described in WO 2014027234, this locking element being pushed onto the end section of the shaft and/or the shaft journal. Thus, two suction drums as a unit (module) are assigned to a twin drawing mill. The carrier has a suction channel connected to a vacuum source, also connected to the interior space of the suction drum by means of corresponding inserts. The inserts are provided with suitably shaped suction slots, so that a corresponding air flow is created at the periphery of the respective drum in a compaction area. Due to this air flow, which is directed essentially transversely to the direction of transport of the fiber material, protruding fibers are also bound into the fiber material.

A ring-shaped drive element in the form of a friction wheel, which is partially in contact with the circular peripheral surface of a shoulder disposed on the end side of the respective suction drum, is in contact along its circular inside surface under the action of a pressure load. The rotational movement of the friction wheel driven over the outside circumference, which is connected to the suction drum, is transferred by means of friction to the circumferential surface of the shoulder. The friction wheel in turn is driven by fiction-locking connection by the driven lower output roller of the drawing mill. Due to a sealing cap attached to the end of the shoulder, the friction wheel is held in its position in the axial direction on the shoulder, so that an axial gap is formed between the closed end side of the suction drum and the friction wheel.

During the compaction process, individual fibers may become detached from the fiber material to be compacted and may be deposited in the interior of the suction drum. This can lead to blockage of the suction slot, so that compaction of the fiber sliver is no longer ensured. Furthermore, fibers may be deposited on the circumference of the suction drum and enter the axial gap between the closed end side of the side of the suction drum and the friction wheel. There is the risk here that fibers entering the axial gap may continue to move as far as the outside circumference of the shoulder and become attached there. The result here is that the inside surface of the friction wheel is no longer in direct contact with the outside circumference of the shoulder, so that continuous transfer of the driving torque from the friction wheel to the suction drum is no longer ensured. As a result, the speed ratio between the suction drum and the lower output roller of the drawing mill changes. This causes initial compression of the fiber material to be compacted in the compaction area, which in turn has a negative effect on the quality of the compaction of the fiber material.

Based on the problems described here, there is therefore the need to remove the suction drum from the carrier after a certain running time of the compaction apparatus and then to free the suction drum of the accumulated fibers. In doing so, the suction drum is pulled jointly with the bearing element pressed into it from the shaft journal by the operator, cleaned outside of the apparatus and placed back on the shaft journal. An important disadvantage is that, after frequent assembly and disassembly of the suction drum, rust due to friction develops on the outside surface of the shaft journal and the inside surface of the bearing element. Therefore, simple and rapid assembly and disassembly of the suction drum are no longer ensured after a longer running time of the apparatus. This has a negative effect on the maintenance cost of the spinning machine.

SUMMARY

An object of the present invention is therefore to design an apparatus for compaction of a fiber sliver on a spinning machine having a suction drum such that simple and rapid assembly and disassembly of the suction drum can be carried out during the entire service life of the apparatus. Additional objects and ad-vantages of the invention will be set forth in part in the following description, or may be obvious from the description, or may be learned through practice of the invention.

Following the respective drawing mill, the compaction apparatus according to the invention may be installed permanently or provided for subsequent attachment to a conventional drawing mill device. In the context of the invention, a bolt is understood to be a short shaft with a round cross section. However, the bolt may also be designed with a profile having n corners.

This object is achieved by the fact that the suction drum is affixed axially with the bolt over the bearing element, as seen in its axial direction, and at least one fastening means is provided, by which the bolt is releasably fastened in the receptacle. The phrase "affixed axially" is to be understood to mean that the bolt is permanently integrated into the module consisting of the suction drum and the bearing element, so that the suction drum and the bolt together form a separate unit of the apparatus. In contrast with the state of the art, simple separation of the suction drum from the bolt is impossible due to the axial fixation of the suction drum and the bolt. The suction drum is removed as a complete structural unit together with the bolt, i.e., the suction drum is not pulled from the bolt. The important advantage of the axial fixation is that it prevents the development of rust due to friction at the connecting point between the bolt and the bearing element. This has a positive effect on the assembly and disassembly of the suction drum and the maintenance cost of the spinning machine. The at least one fastening means may be integrated into the carrier or may be a separate part on the carrier. For example, it is possible for a screw that secures the bolt in its operating position in the receptacle in the axial direction to be fastened onto the carrier. It is also possible for the bolt to have a radial hole, into which a securing pin fastened on the carrier protrudes in the operating position and secures the bolt in the axial direction in the receptacle. It has proven to be advantageous if the fixed connection of the suction drum and the bolt is accomplished via a roller bearing, comprising an outer ring, an inner ring and a rolling element. The suction drum is connected in a rotationally fixed manner to the outer ring on the closed end face of the suction drum, and the end section of the bolt is connected to the inner ring of the roller bearing, for example, by means of a press fit. The suction drum is mounted on the bolt so that it can rotate by means of the rolling elements. This type of fixed connection has the advantage that it is simple to assemble the separate unit. There is also the possibility that the fixed connection of the suction drum and the bolt is accomplished by means of a roller bearing without an inner ring, i.e., the roller bearing comprises only an outer ring and rolling elements. The suction drum is connected to the outer ring in a rotationally fixed manner and is supported on the end section of the bolt, so that it can rotate by means of the rolling elements. In contrast with the roller bearing having the inner ring, the rolling elements, for example, the bearing balls are in direct contact with the surface of the bolt. The bolt is therefore advantageously made of a hardened steel or ceramic or has a surface coating. In order to ensure good running of the rolling elements, the bolt also has peripheral grooves on its surface in which the rolling elements roll. In this type of fixed connection, the bolt and the roller bearings form a subassembly of the separate unit. This further simplifies the assembly of the separate unit, because the subassembly can be mounted on the suction drum in a single assembly step.

It has proven advantageous if the fastening device is designed as a locking element, which is provided with a subsection that can yield in the radial direction in a flexible manner and the bolt has a peripheral recess between its two end portions, wherein the flexibly yielding subsection protrudes into the peripheral recess in the bolt in the operating position and secures the bolt on the carrier in the axial direction. "Recess" is understood to be a groove running continuously over the circumference of the bolt. The diameter of the bolt advantageously decreases toward the recess at an angle between 25° and 60° with respect to the central axis of the bolt. This ensures good axial fixation of the bolt in the receptacle. In order for the bolt to be securely displaceable into its end position by means of the locking element in assembly, it is further advantageous if the diameter of the bolt at the end of the bolt tapers at an angle between 25° and 60° toward the central axis of the bolt. This prevents the bolt from running onto the locking element and blocking it when inserted into the receptacle.

In transferring the bolt into the receptacle, the proposed flexibly yielding subsection is displaced by the bolt in the radial direction. The reason for this is that the diameter of the bolt is larger than the inside diameter of the receptacle at the location of the flexibly yielding subsection. Due to the radial displacement of the flexibly yielding subsection, the bolt can be transferred into its end position (locking position) with no problem. In the end position the flexibly yielding subsection can widen elastically again into the peripheral recess in the bolt, i.e., in the end position the flexibly yielding subsection returns to its original radial form because of its elasticity and is held securely in the recess in the bolt.

The locking element and the recess cooperate in the manner of a snap connection by means of which the suction drum can easily be assembled on the apparatus and/or disassembled from it. At the same time, a good axial fixation of the suction drum on the carrier of the apparatus is ensured by means of the snap connection. To further reinforce the axial fixation of the bolt, it is furthermore possible for the carrier to have a plurality of locking elements which engage in the peripheral recess in the bolt.

In addition, it is advantageous if the receptacle is designed as a sleeve which is disposed in a rotationally fixed manner in the carrier and has the flexibly yielding subsection. In this way it is possible to provide the carrier with a simple hole into which the sleeve is inserted. The rotationally fixed arrangement of the sleeve in the carrier is accomplished, for example, by means of a type of shaft-hub connection wherein the carrier has an elevation, and on its outside circumference the sleeve has a recess into which the elevation protrudes. The subsection which is flexibly yielding in the radial direction extends over a portion of the circumference of the sleeve and protrudes in its resting position into the cavity in the sleeve, so that the inside diameter of the sleeve at this location is smaller than the diameter of the bolt. The sleeve is advantageously manufactured from a plastic which has good elastic properties.

It has also proven to be advantageous if the subsection, which yields flexibly, consists of at least one tongue-shaped section, which extends in the longitudinal direction of the bolt and whose free end protrudes into the peripheral recess in the bolt. Axial fixation of the bolt with the rotatably mounted suction drum on the carrier of the apparatus is ensured by the at least one flexible tongue-shaped section protruding radially into the recess in the bolt in the end position described above. It is advantageous here if the free end of the tongue-shaped section points in the direction of the suction drum. This permits a simple and rapid transfer of the bolt into its end position without any great expenditure of force.

Finally, it is advantageous if the inside surface of the tongue-shaped section whose free end protrudes into the peripheral recess at least partially in the radial direction, runs at an angle between 10° and 25° with respect to the central axis of the bolt. This ensures that the tongue-shaped section can move completely into the region of the recess in the bolt in displacement (assembly) of the bolt.

BRIEF DESCRIPTION OF THE DRAWINGS

The invention will now be described in greater detail on the basis of the following exemplary embodiments, in which.

DETAILED DESCRIPTION

Figure 1:
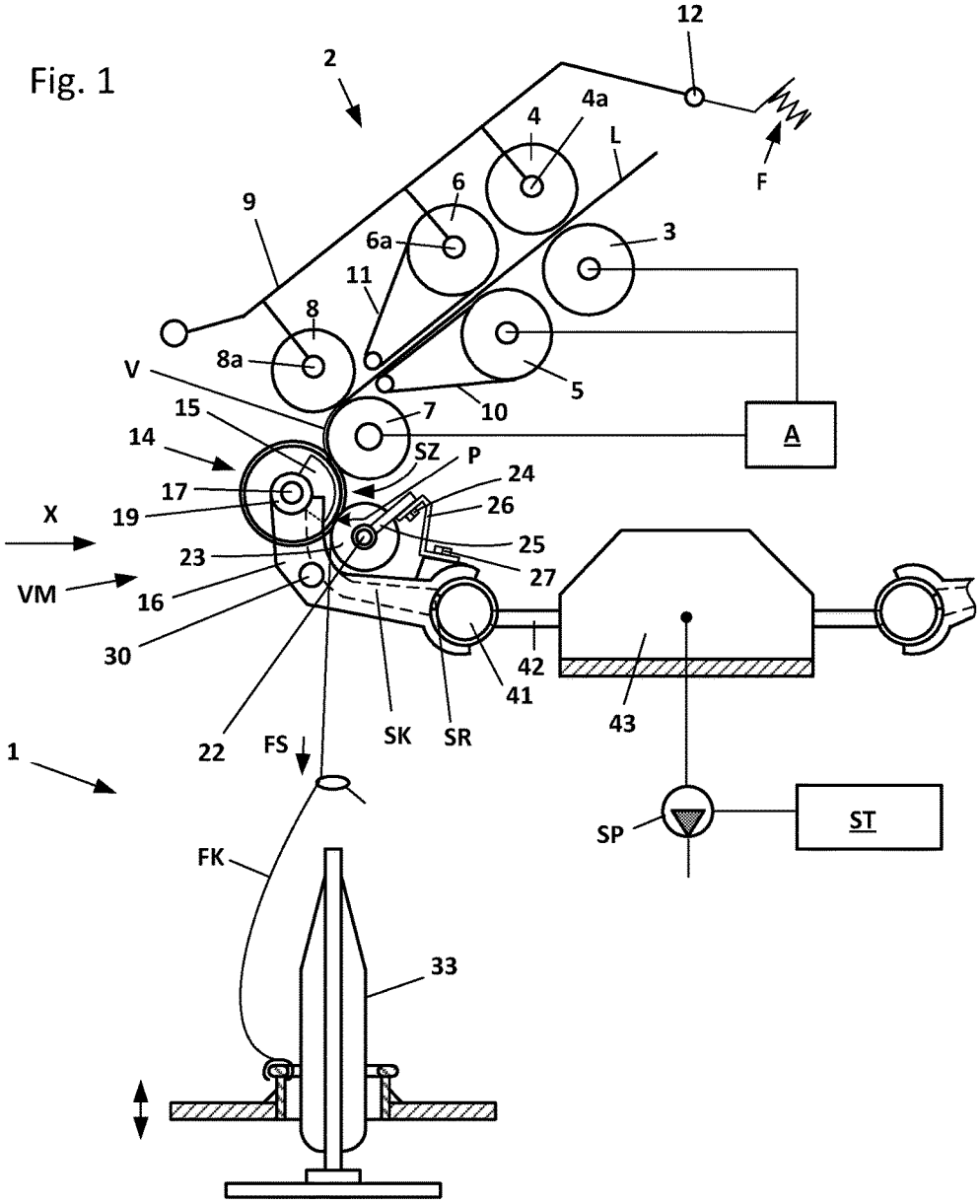
FIG. 1 shows a schematic side view of a spinning station of a ring-spinning machine having a drawing mill unit and a compaction apparatus connected thereto.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a spinning station 1 on a spinning machine (ring-spinning machine) having a drawing mill unit 2, which is provided with an input roller pair 3, 4, a central roller pair 5, 6 and an output roller pair 7, 8. A belt 10,11, which is held in its position around a cage (not shown further), as shown here, is passed around each of the central rollers 5, 6. The top rollers 4, 6, 8 of the aforementioned roller pairs are embodied as pressure rollers which are mounted so that they are rotationally moveable by means of the axes 4*a*, 6*a*, 8*a* on a pivotably mounted pressure arm 9. The pressure arm 9 is mounted to be pivotable about an axis 12 and, as shown schematically here, is acted upon by a spring element F. The rollers 4, 6, 8 are pressed against the lower rollers 3, 5 and 7 of the roller pairs by means of the spring loading which is indicated schematically here. The roller pairs 3, 5, 7 are connected to a drive A as indicated schematically. The pressure rollers 4, 6, 8 and/or the belt 11 are driven by friction via the belt 10 and via the driven bottom rollers 3, 5, 7. The circumferential velocity of the driven roller 5 is somewhat higher than the circumferential velocity of the driven roller 3 so that the fiber material supplied to the drawing mill unit 2 in the form of a sliver L is subjected to a pre-drawing between the input roller pair 3, 4 and the central roller pair 5, 6. The main drawing of the fiber material 11 occurs between the central roller pair 5, 6 and the output roller pair 7, 8, wherein the output roller 7 has a much higher circumferential velocity than the central roller 5.

Figure 2:
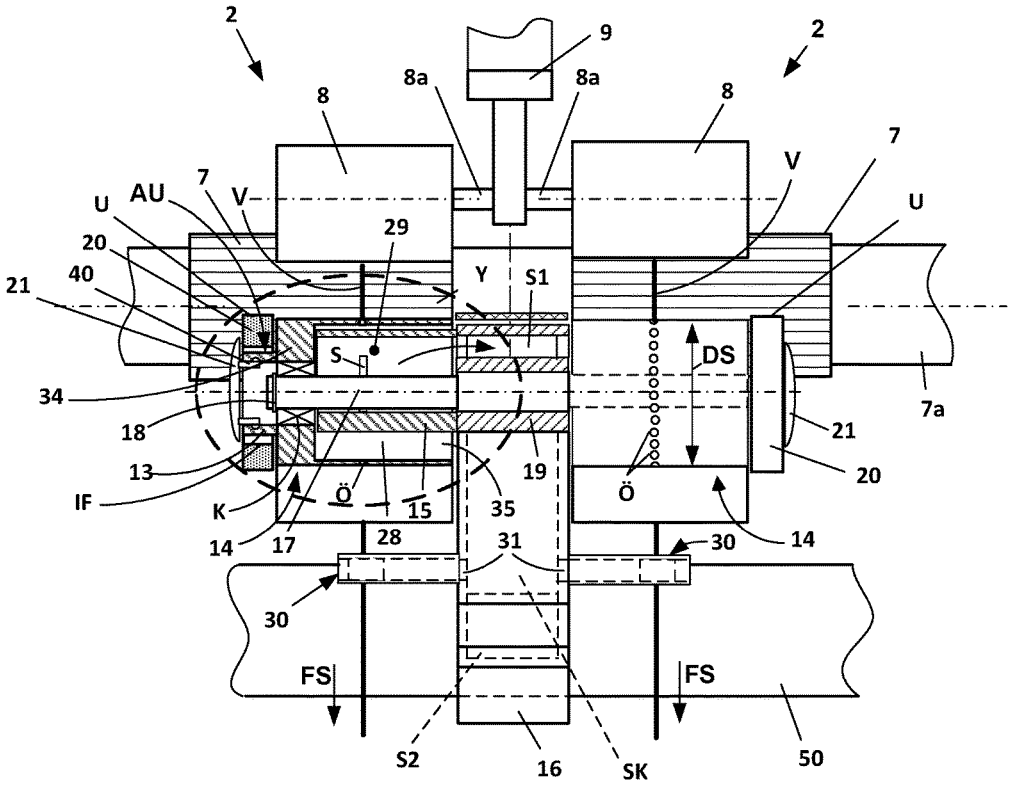
FIG. 2 shows an enlarged partial view X according to FIG. 1 having two drawing mill units situated side by side and a compaction apparatus which is fastened onto a carrier and belongs to the state of the art.

As indicated in FIG. 2 (view X according to FIG. 1), a pressure arm 9 is assigned to two neighboring drawing mill units 2 (twin drawing mill). Since these are the same elements of the neighboring drawing mill units 2 and/or compaction apparatuses VM and/or are partially disposed in mirror image, the same reference numerals are used for these parts.

Connected to the drawing mill unit 2, the spinning machine has a pivotably mounted compaction apparatus VM for compaction of a fiber sliver (fiber material) V discharged from the drawing mill unit. The compaction apparatus VM is subsequently mounted on the drawing mill unit 2. The compaction apparatus VM has two driven and revolving suction drums 14, which are acted upon with suction air and are mounted to be axially parallel and rotatable at a distance from one another on a carrier 16. The carrier 16 has a suction channel SK which is connected to a vacuum source SP and is also connected to the interior space of the suction drums 14 via corresponding inserts 15. The compaction apparatus VM is described in detail in WO 2012068692 A1.

The drawn fiber material V discharged from the output roller pair 7, 8 is deflected downward and enters the region of a suction zone SZ of a downstream suction drum 14. The respective suction drum 14 is provided with perforations, i.e., openings Ö running on its circumference. A suction insert 15 in a stationary mount is disposed inside the rotatably mounted suction drum 14. As shown schematically in FIG. 2, the respective suction insert 15 is held by the carrier 16 in its installed stationary position by holding means (not shown in greater detail). As indicated schematically, the respective suction insert 15 has a suction slot S (FIG. 2) on a partial area of its circumference, extending essentially over the suction zone SZ. The respective suction drum 14 is mounted on a shaft 17 rotatably by means of a bearing K in the region of its outer end. For axial fixation of the suction drum 14 on the shaft 17, a securing ring 18 mounted on the shaft 17 suppresses the axial displacement of the suction drum 14 during operation.

A suction channel SK, which has one opening S2 on the inside surface of the end piece of the carrier 16 and another opening S1, which is disposed in the area of the receptacle 19 and communicates with the interior space 29 of the respective suction insert 15, runs inside the carrier 16. The opening S2 is opposite an opening SR in a suction tube 41 in the working position, so that the interior space of the suction tube 41 is connected to the suction channel SK. As shown in FIG. 1, the suction tube 41 is connected via one or more connecting channels 42 to a central main channel 43. This channel 43 is connected to a vacuum source SP, which can be controlled by means of a control unit ST.

The shaft 17 is fastened in a receptacle 19 of the carrier 16. The shaft 17 has a somewhat larger diameter in the area of the receptacle 19, while the ends of the shaft 17 extending from this receptacle to both sides have a tapered diameter and serve to receive the respective bearing K. On its closed end 35, i.e., the end facing away from the carrier 16, the respective suction drum 14 has a ring-shaped shoulder 13. A partial area of the inside surface IF of a ring-shaped drive element 20 sits on a partial area of the outside circumference AU of the shoulder 13. The drive element 20 is thus embodied as a friction wheel.

In the position shown in FIG. 2, the respective suction drum 14 is in a working position, in which the outside circumference U of the drive element 20 sits on the outside circumference of the driven output roller 7 by means of a suitably applied pressure load. In other words, the drive element 20 is driven by the roller 7 in a first gear by means of friction. Also by means of friction, the friction drive element 20 switches the drive to a second gear on the ring-shaped shoulder 13 of the suction drum 14. This takes place at the location where the inside surface IF of the friction wheel 20 and the outside circumference AU of the shoulder 13 come in contact and/or rest against one another. As shown in FIG. 2, a closing cap 21 is fastened in the region of the ring-shaped shoulder 13. The friction drive element 20 is held in its position on the shoulder 13 in the axial direction by the closing cap 31, wherein there is an axial gap between the end face 35 of the suction drum 14 and the drive element 20 in the operating position.

A clamping roller 23 which sits on the respective suction drum 14 by means of a compressive load and forms a clamping line P with the drum, is provided for each one of the suction drums 14. The respective clamping roller 23 is mounted rotatably on an axle 22, which is fastened on a bearing element 25 that is connected by screws 27 to a spring element 26. The spring element 26, by means of which a pressing force of the clamping roller 23 is generated in the direction of the suction drum 14, is fastened on the carrier 16 by means of the screws 27, which are indicated schematically. The clamping line P at the same time forms a so-called "rotational locking gap," from which fiber material is supplied or sent in the form of a compressed yarn FK to a ring-spinning machine 1, which is shown schematically, in the direction of feed FS, while imparting a twist.

In order to be able to vacuum up the yarn FK additionally supplied via the clamping point P in the event of a thread break between the clamping line P and the bobbin 33, a suction tube 30, whose respective opening 31 facing the carrier 16 is connected to the channel SK, is fastened on both sides of the respective carrier 16. In other words, when a thread break occurs, the end of the thread and/or yarn, which is still being supplied, is sent over the suction channel SK to the exhaust pipe 30 under the influence of the vacuum generated via the vacuum source SP, the exhaust pipe supplying delivering this vacuum to the main channel 43 via the channel(s) 42 for further discharge to a collecting point.

During the compaction operation, individual fibers may be loosened from the fiber material V to be compacted and become deposited in the interior space 28 of the suction drum 14. This can lead to blockage of the suction slot S, so that compaction of the fiber material V is no longer ensured. Furthermore, fibers may be deposited on the periphery of the suction drum 14 and enter the axial gap between the closed end face 34 of the suction drum 14 and the friction wheel 20 due to airflow. The danger here is that fibers entering the axial gap might continue to move as far as the outside circumference AU of the shoulder 13 and be deposited there. This results in the inside surface IF of the friction wheel 20 no longer being in direct contact with the outside circumference AU of the shoulder 13 so that a continuous transfer of the driving torque from the friction wheel 20 to the suction drum 14 is no longer ensured. As a result, there is a change in the speed ratio between the suction drum 14 and the lower output roller 7 of the drawing frame changes. In this way, the fiber material V to be compacted becomes compressed in the compaction region, which has a negative effect on the quality of the compaction of the fiber material V.

Because of the problems described here, there is therefore the need to remove the suction drum 14 from the carrier 16 after a certain running time of the compaction apparatus VM and then to free the suction drum 14 of the accumulated fibers. In doing so, the suction drum 14 is jointly removed by the operating personnel from the shaft 17 together with the bearing element K pressed in, then cleaned outside of the apparatus VM and placed back on the shaft 17. A significant disadvantage here is that, after frequent assembly and disassembly of the suction drum 14, rust develops due to friction on the outside surface of the shafts 17 and the inside surface of the bearing element K. Therefore, quick and simple assembly and/or disassembly of the suction drum 14 are no longer ensured with longer running times of the apparatus VM. This in turn has a negative effect on the cost of maintenance of the spinning machine.

Figure 3:
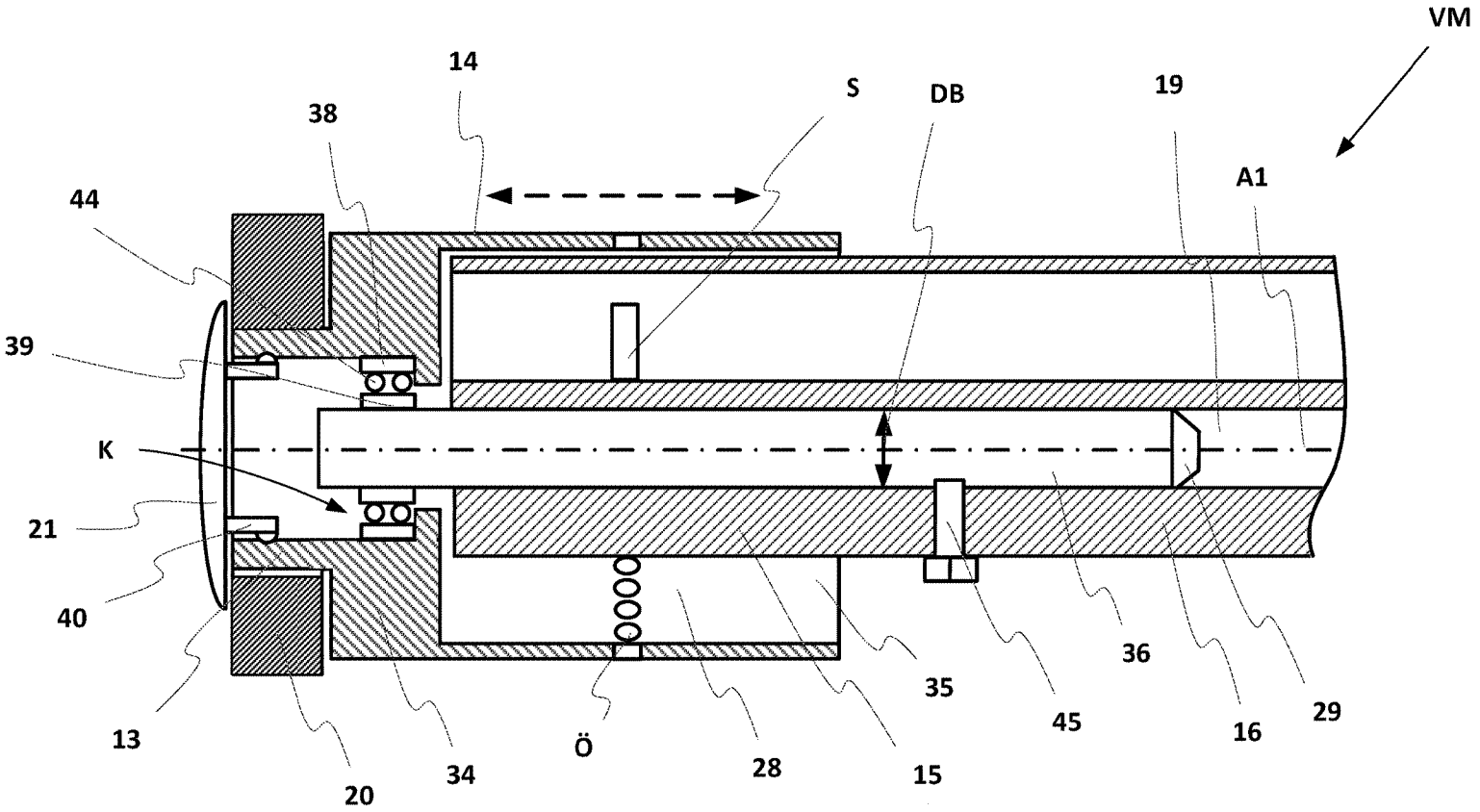
FIG. 3 shows an enlarged partial view Y according to FIG. 2 of a compaction apparatus designed according to the invention.

FIG. 3 illustrates an enlarged partial view Y according to FIG. 2 of an apparatus VM designed according to the invention with a suction drum 14 and a bolt 36, wherein the bolt 36 in this embodiment is connected to the bearing element K in a rotationally fixed manner. The bearing element K is designed as a roller bearing comprising an outer ring 38, an inner ring 39 and rolling elements 44. This suction drum 14 is connected to the outer ring 38 and the bolt 36 is connected to the inner ring 39 via a press fit in a rotationally fixed manner. The suction drum 14 is mounted rotatably on the inner ring 39 connected to the end section of the bolt 36 via the rolling elements 44. In contrast with the state of the art (FIG. 2), the suction drum 14 is axially secured in its axial direction with by connection to the bolt 36 via the roller bearing K. The suction drum 14 and the bolt 36 therefore together form a separate unit of the apparatus VM. In contrast with the state of the art, a simple separation of the suction drum 14 from the bolt 36 is impossible due to the axial fixation of the suction drum 14 and the bolt 36, so that the development of rust due to friction at the connecting point between the bolt 36 and the roller bearing K is prevented.

A suction insert 15, which has a suction slot S on a partial area of its circumference, is disposed in the interior space 28 of the suction drum 14. The suction insert 15 is integrated into the carrier 16 in this exemplary embodiment. To accommodate the bolt 36, the carrier 16 has a receptacle 19. In order for the bolt 36 to be easily insertable into the receptacle 19, the bolt 36 has a tapering of its diameter DB on its end protruding out of the suction drum 14. In the exemplary embodiment according to FIG. 3, the separate unit is releasably fastened via a screw 45 in the receptacle 19 of the carrier 16. This prevents any axial displacement of the bolt 36 in its operating position.

In the region of the annular shoulder 13 on the suction drum 14, a closing cap 21, which protrudes at its outside diameter beyond the inside diameter of the friction wheel 20 is fastened in that region. The closing cap 21 is provided with an annular shoulder 40, which protrudes into the inside clearance of the annular shoulder 13 on the suction drum 14. The annular attachment 40 is provided with additional cams, which protrude outward and engage in peripheral recesses within the inside clearance of the shoulder 13 for fixation of the closing cap 21.

Figure 4:
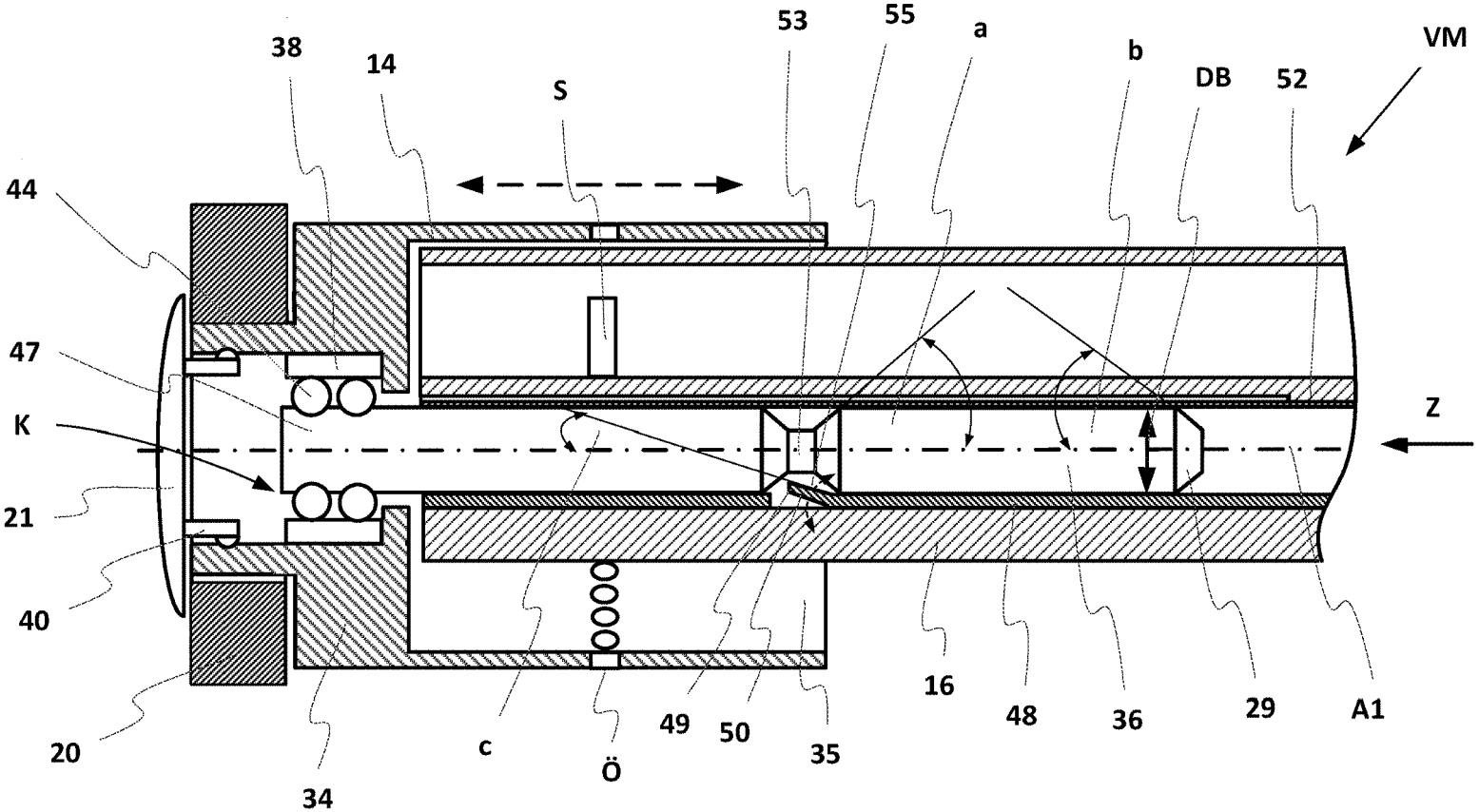
FIG. 4 shows an enlarged partial view Y according to FIG. 2 of another compaction apparatus designed according to the invention.

FIG. 4 shows an enlarged partial view Y according to FIG. 2 of another apparatus VM, designed according to the invention and having a suction drum 14 and a bolt 36. In this embodiment the bearing element K is designed as a roller bearing without an inner ring, i.e., the roller bearing comprises only an outer ring 38 and rolling elements 44. This suction drum 14 is connected to the outer ring 38 via a press fit in a rotationally fixed manner and is supported directly via the rolling elements 44 on the end section of the bolt 36 so that it can rotate. In contrast with a roller bearing having an inner ring, the rolling elements 44, for example, bearing balls, are in direct contact with the surface of the bolt 36. In order to ensure good running of the rolling elements 44, the bolt 36 also has on its surface peripheral grooves 47 in which the rolling elements 44 roll.

In contrast with the exemplary embodiment in FIG. 3, the carrier 16 has a separate sleeve 48 to receive the bolt 36. The sleeve 48 is disposed in a rotationally fixed manner in the carrier 16 by means of a type of shaft-hub connection wherein the carrier 16 has an elevation 52 and a sleeve 48 has a recess 51 on its outer circumference (FIG. 5), the elevation 52 protruding into said recess. To secure the bolt 36 axially, the sleeve 48 has a locking element with a subsection 50, which can yield flexibly in the radial direction. The flexibly yielding subsection 50 is a tongue-shaped section, which is formed over a portion of the circumference of the sleeve 48. In its resting position the tongue-shaped section 50 protrudes into the cavity 54 (FIG. 5) in the sleeve 48, so that the inside diameter LD (FIG. 5) of the sleeve 48 is smaller at this point than the diameter DB of the bolt 36. The bolt 36 has a peripheral recess and/or groove 53 between its two end sections, wherein the tongue-shaped section 50 protrudes into the peripheral recess 53 on the bolt 36 in the operating position and secures the bolt 36 on the carrier 16 in the axial direction. It can be ascertained from FIG. 2 that two suction drums 14 of neighboring spinning stations are mounted rotatably on the carrier 16. There is therefore the possibility that the sleeve 48 serves as a receptacle for both suction drums 14.

In transferring the bolt 36 into the sleeve 48, the tongue-shaped section 50 is displaced through the bolt 36 in the radial direction. The reason for this is that the diameter DB of the bolt 36 is larger than the inside diameter LD of the sleeve 48 (FIG. 5) at the location of the tongue-shaped section 50. Due to the radial displacement of the tongue-shaped section 50, the bolt 36 can be transferred to its end position (locked position) with no problem. In the end position, the tongue-shaped section 50 can yield elastically again into the peripheral recess 53 in the bolt 36, i.e., the tongue-shaped section 50 returns to its original radial shape in the end position because of its elasticity and is held securely in the recess 53 in the bolt 36.

The diameter DB of the bolt 36 decreases toward the recess 53 at an angle a between 25° and 60° with respect to the central axis A1 of the bolt 46. This ensures good axial fixation of the bolt 36 in the sleeve 48. In order for the bolt 36 to be able to be displaced securely over the tongue-shaped section 50 into its end position during assembly, the diameter DB of the bolt 36 tapers at an angle b between 25° and 60° with respect to the central axis A1 of the bolt 36 on the end protruding out of the suction drum 14. This prevents the bolt 36 from running onto the tongue-shaped section 50 on insertion into the sleeve 48 and being thereby blocked.

The free end 49 of the tongue-shaped section 50 points in the direction of the suction drum 14. This permits a simple and rapid transfer of the bolt 36 into its end position without exerting any great force. The inside surface of the tongue-shaped section 50 whose free end 49 protrudes at least partially in the radial direction into the peripheral recess 53, runs at an angle c between 10° and 25° with respect to the central axis A1 of the bolt 36. This ensures that the tongue-shaped section 50 can move completely into the region of the recess 53 in the bolt 36 in the displacement (assembly) of the bolt 36.

The locking element 50 and the recess 53 interact like a type of snap connection by means of which the separate unit of suction drum 14 and bolt 36 can easily be assembled and disassembled on the carrier 16 of the apparatus VM. At the same time, a good axial securing of the separate unit on the carrier 16 of the apparatus VM is ensured by means of the snap connection.

As in the exemplary embodiment shown in FIG. 3, a closing cap 21, which protrudes beyond the inside clearance of the friction wheel 20 with its outside diameter is fastened in the region of the annular shoulder 13. The closing cap 21 is provided with an annular shoulder 40 which protrudes into the inside clearance of the annular shoulder 13 of the suction drum 14. Due to the closing cap 21, the friction wheel 20 is held in its position in the axial direction on the ring-shaped shoulder 13.

Figure 5:
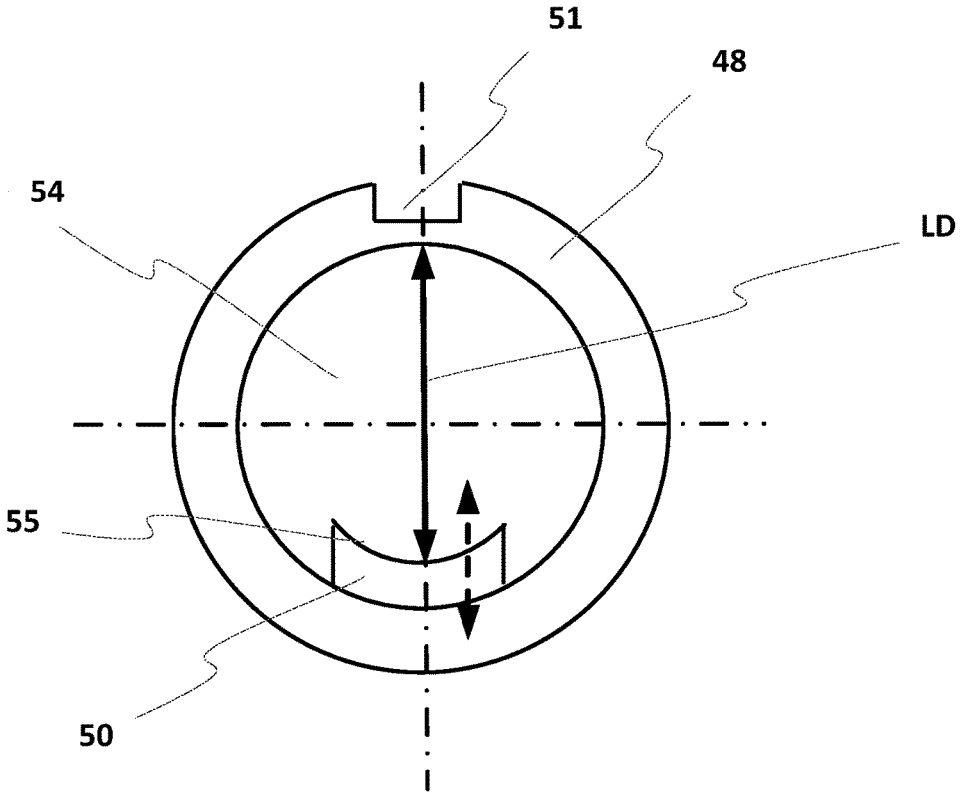
FIG. 5 shows a side view Z of a sleeve according to FIG. 4.

FIG. 5 shows a side view Z of the sleeve 48 according to FIG. 4. The sleeve 48 has on its outer circumference a recess 51 into which the elevation 52 on the carrier 16 protrudes for fixation thereof in the carrier 16 (FIG. 4). The subsection 50, which is designed as a tongue-shaped section and yields flexibly in the radial direction, protrudes in its resting position into the cavity 54 in the sleeve 48. In this way, the inside diameter LD is established at the location of the tongue-shaped section 50 in the sleeve 48. The tongue-shaped section 50 can yield in the radial direction with no problem so that the inside diameter LD increases when the bold 36 with its diameter DB is displaced over the tongue-shaped section 50 during assembly. The inside surface 55 of the tongue-shaped section 50 is provided with a radius, which facilitates and enables the insertion of the bolt 36 into the sleeve 48. As soon as the recess 53 in the bolt 36 (FIG. 4), as seen in the axial direction, is situated completely at the height of the tongue-shaped section 50, the inside diameter LD is reduced due to the elasticity of the tongue-shaped section (spring action) so that the tongue-shaped section 50 is shifted into the recess 53 in the bolt 36.

Modifications and variations can be made to the embodiments illustrated or described herein without departing from the scope and spirit of the invention as set forth in the appended claims.

The invention claimed is:

1. An apparatus for compacting a fiber sliver on a spinning machine, comprising:

a carrier, and a receptacle defined in the carrier;

a bolt received in the receptacle;

a rotatably mounted suction drum affixed to a first end section of the bolt, the suction drum comprising a closed end face and an open end face;

a bearing element disposed at the closed end face, the suction drum mounted on the first end section of the bolt by the bearing element, wherein an opposite free end of the bolt protrudes out of the open end face of the suction drum;

the suction drum affixed axially by the bearing element with the bolt so that the suction drum and the bolt form a single unit that is removable from the apparatus without removing the suction drum from the bolt, and the single unit insertable back into the apparatus by insertion of the free end of the bolt into the receptacle; and a fastening device that releasably fixes the bolt in the receptacle.

2. The apparatus according to claim 1, wherein the fastening device is a radial fastening device.

3. The apparatus according to claim 1, wherein the bearing element is a roller bearing comprising an outer ring, an inner ring connected to the end section of the bolt, and rolling elements, the suction drum connected to the outer ring in a rotationally fixed manner and the bolt connected to the inner ring, and the suction drum rotatable on the inner ring via the rolling elements.

4. The apparatus according to claim 1, wherein the bearing element is a roller bearing comprising an outer ring and rolling elements, the suction drum connected to the outer ring in a rotationally fixed manner with the rolling elements disposed between the outer ring and the end section of the bolt such that the suction drum is directly supported by the rolling elements for rotation on the end section of the bolt.

5. The apparatus according to claim 1, wherein the carrier is housed in a receptacle, and further comprising a screw in the receptacle that releasably fastens the bolt in the carrier.

6. The apparatus according to claim 1, further comprising a securing pin fastened on the carrier that engages to axially fix the bolt in the receptacle.

7. An apparatus for compacting a fiber sliver on a spinning machine, comprising:

a carrier, and a receptacle defined in the carrier;

a bolt received in the receptacle;

a rotatably mounted suction drum affixed to the bolt, the suction drum comprising a closed end face and an open end face;

a bearing element disposed at the closed end face, the suction drum mounted on an end section of the bolt by the bearing element, wherein an end of the bolt protrudes out of the open end face of the suction drum;

the suction drum affixed axially by the bearing element with the bolt so that the suction drum and the bolt form a single unit that is removable from the apparatus; and a fastening device that releasably fixes the bolt in the receptacle; and wherein the fastening device comprises a locking element having a subsection that is flexibly yielding in a radial direction toward the bolt, the bolt further comprising a peripheral recess into which the subsection protrudes to axially fix the bolt in the receptacle.

8. The apparatus according to claim 7, wherein the receptacle is defined by a sleeve disposed in the carrier in a rotationally fixed manner, the locking element configured on the sleeve.

9. The apparatus according to claim 8, wherein the sleeve is plastic.

10. The apparatus according to claim 7, wherein a diameter of the bolt decreases toward the recess in the bolt at an angle between 25° and 60° with respect to a central axis of the bolt.

11. The apparatus according to claim 7, wherein a diameter of the bolt tapers at the end of the bolt protruding out of the suction drum at an angle between 25° and 60° with respect to a central axis of the bolt.

12. The apparatus according to claim 7, wherein the flexibly yielding subsection comprises a tongue-shaped section that extends in a longitudinal direction of the bolt and has a free end that protrudes into the peripheral recess in the bolt.

13. The apparatus according to claim 12, wherein the free end of the tongue-shaped section points in a direction of the suction drum.

14. The apparatus according to claim 12, wherein an inside surface of the tongue-shaped section runs at an angle between 10° and 25° with respect to a central axis of the bolt.

15. A spinning machine comprising the apparatus for compaction of a fiber sliver according to claim 1.

* * * * *